US008214923B2

(12) United States Patent
Lee

(10) Patent No.: US 8,214,923 B2
(45) Date of Patent: Jul. 10, 2012

(54) MULTI-USE GARMENT

(76) Inventor: Robin L. Lee, Hinsdale, IL (US)

( * ) Notice: Subject to any disclaimer, the term of this patent is extended or adjusted under 35 U.S.C. 154(b) by 914 days.

(21) Appl. No.: 12/126,641

(22) Filed: May 23, 2008

(65) Prior Publication Data

US 2009/0126070 A1 May 21, 2009

Related U.S. Application Data

(60) Provisional application No. 60/989,530, filed on Nov. 21, 2007.

(51) Int. Cl.
*A41B 13/06* (2006.01)

(52) U.S. Cl. ..... 2/69.5; 2/70; 2/88

(58) Field of Classification Search ..... 2/70, 1, 2/69, 69.5, 91, 105, 210, 211, 213, 88, 74, 2/89

See application file for complete search history.

(56) References Cited

U.S. PATENT DOCUMENTS

| | | | | | |
|---|---|---|---|---|---|
| 906,551 | A | * | 12/1908 | Newman | 2/69.5 |
| 1,496,283 | A | * | 6/1924 | Wright | 2/88 |
| 1,736,594 | A | * | 11/1929 | Hart | 2/88 |
| 2,097,175 | A | * | 10/1937 | Cowf | 2/213 |
| 2,720,654 | A | * | 10/1955 | Stephenson | 2/69 |
| 3,079,611 | A | * | 3/1963 | Boryszewski | 2/89 |
| 3,106,717 | A | * | 10/1963 | Cuvin | 2/70 |
| 3,160,892 | A | * | 12/1964 | Semons | 2/88 |
| 3,473,167 | A | * | 10/1969 | Jeffrey | 2/74 |
| 3,797,043 | A | * | 3/1974 | Brument | 2/69.5 |
| 4,142,264 | A | * | 3/1979 | Whiting | 5/482 |
| 4,180,867 | A | * | 1/1980 | Ridgeway, Jr. | 2/89 |
| 4,217,662 | A | * | 8/1980 | Buchman | 2/69.5 |
| 4,258,439 | A | * | 3/1981 | York | 2/69.5 |
| 4,484,362 | A | * | 11/1984 | Asher | 2/69 |
| 4,919,081 | A | | 4/1990 | Lewellen | |
| D402,439 | S | * | 12/1998 | Marks | D2/757 |
| D402,440 | S | * | 12/1998 | Marks | D2/851 |
| 5,875,492 | A | * | 3/1999 | Moss | 2/93 |
| 6,986,163 | B2 | * | 1/2006 | Dugan | 2/69 |
| 7,036,153 | B2 | * | 5/2006 | Gibson et al. | 2/69 |
| 7,748,058 | B2 | * | 7/2010 | Steitle | 2/244 |
| 2007/0055207 | A1 | | 3/2007 | Dureus | |

FOREIGN PATENT DOCUMENTS

| | | |
|---|---|---|
| GB | 478027 | 1/1938 |

OTHER PUBLICATIONS

International Search Report Corresponding to PCT/US08/084326 dated Jan. 28, 2009.

* cited by examiner

*Primary Examiner* — Katherine Moran
*Assistant Examiner* — Richale Quinn
(74) *Attorney, Agent, or Firm* — Levenfeld Pearlstein, LLC

(57) ABSTRACT

A multi-purpose unisex garment that can be worn in a variety of configurations on different parts of the body and for a variety of occasions. The garment includes a first sheet of material and a second sheet of material, which is positioned opposite the first sheet of material. The first and second sheets of material are secured to one another at or near two opposite ends of the sheets of material. The two other opposite ends of the sheets of material are open to allow a part of the body to pass through at least one of the openings. At least one of the open ends has a securing device positioned along at least a portion of the opening that may securely close at least a portion of the respective opening to secure the garment about the person.

16 Claims, 14 Drawing Sheets

101
205
105
207
208

205
206
208

101
205
100
207
206
208

207
101
205
100
206
208

MULTI-USE GARMENT

CROSS-REFERENCE TO RELATED APPLICATIONS

This application claims the benefit of the filing date of U.S. Provisional Application No. 60/989,530, entitled "MULTI-PURPOSE REVERSIBLE UNISEX GARMENT," filed on Nov. 21, 2007, which is incorporated herein by reference to the extent permitted by law.

FIELD OF THE INVENTION

The present invention relates generally to the field of garments, and more particularly to multi-purpose unisex garments.

BACKGROUND OF THE INVENTION

Conventional clothing items are designed for and function with a single purpose, such as pants or a dress. With the varied activities of modern life, there is a need for garments that can be worn anywhere and are easily modified for different occasions. The need exists for a versatile garment that allows a user to modify what they are wearing to their current activity. Conventional clothing items do not allow for this level of versatility.

SUMMARY OF THE INVENTION

A garment consistent with the present invention solves the above-mentioned problem by providing a multi-purpose unisex garment that can be worn in a variety of configurations on different parts of the body and for a variety of occasions. The garment comprises a first sheet of material and a second sheet of material, which is positioned opposite the first sheet of material. The first and second sheets of material are secured to one another at or near two opposite ends of the sheets of material. The two other opposite ends of the sheets of material are open to allow a part of the body to pass through at least one of the openings. At least one of the open ends has a securing device positioned along at least a portion of the opening that may securely close at least a portion of the respective opening to secure the garment about the person. The two sheets of material may be a common piece of material that is folded to form the two sheets of material.

The garment can be secured around all areas of the body including, but not limited to, the neck, head, shoulders, chest, waist, and the like, and can have a variety sizes. The garment can be worn in a variety of different ways including, but not limited to, as a skirt, dress, cover-up, evening gown, poncho, cape, hat, scarf, blanket, after-shower wear, after-have wear, after-swim wear, loungewear, and the like. Further, multiple garments consistent with the present invention may be worn simultaneously. For example, one garment may be worn and secured around the shoulders while a second garment may be secured around the waist.

In accordance with devices consistent with the present invention, a garment is provided that comprises a first panel of material and a second panel of material opposite the first panel of material and secured to the first panel of material along a first connection line and a second connection line, which is spaced apart from and generally parallel to the first connection line. A first end of the first and second panels and a second end of the first and second panels are at least partially unsecured to one another providing a first opening in the garment at the first end and a second opening in the garment at the second end. The first end and the second end are each generally perpendicular to the first connection line and the second connection line. A securing device is attached along a first portion of the first end that removeably secures the first panel to the second panel along the first end. The first panel and second panel are fixedly secured to one another along a second portion of the first end. The securing device tightens the first opening at the first end about a wearer of the garment.

Other systems, methods, features, and advantages of the present invention will be or will become apparent to one with skill in the art upon examination of the following figures and detailed description. It is intended that all such additional systems, methods, features, and advantages be included within this description, be within the scope of the invention, and be protected by the accompanying claims.

BRIEF DESCRIPTION OF THE DRAWINGS

The accompanying drawings, which are incorporated in and constitute a part of this specification, illustrate an implementation of the present invention and, together with the description, serve to explain the advantages and principles of the invention. In the drawings.

DETAILED DESCRIPTION OF THE INVENTION

Figure 1:
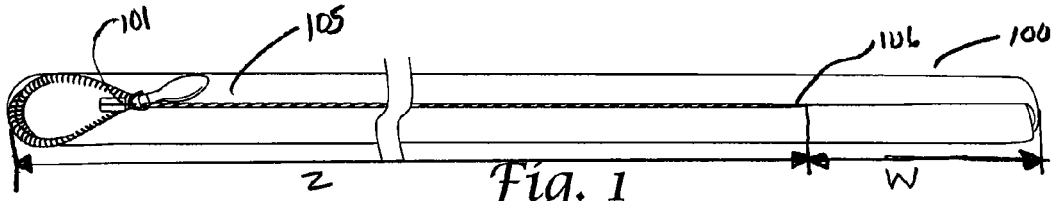
FIG. 1 depicts a top perspective view of an illustrative garment consistent with the present invention.
Figure 2:
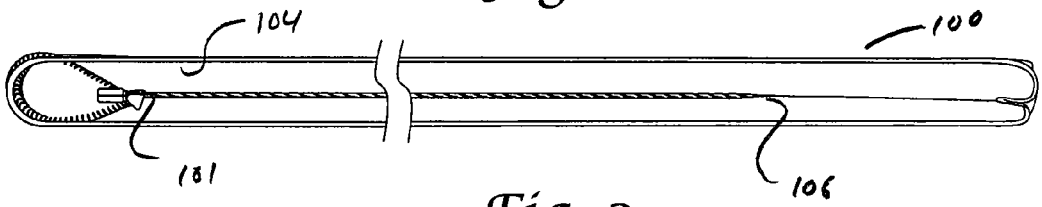
FIG. 2 depicts a bottom perspective view of the garment.
Figure 3:
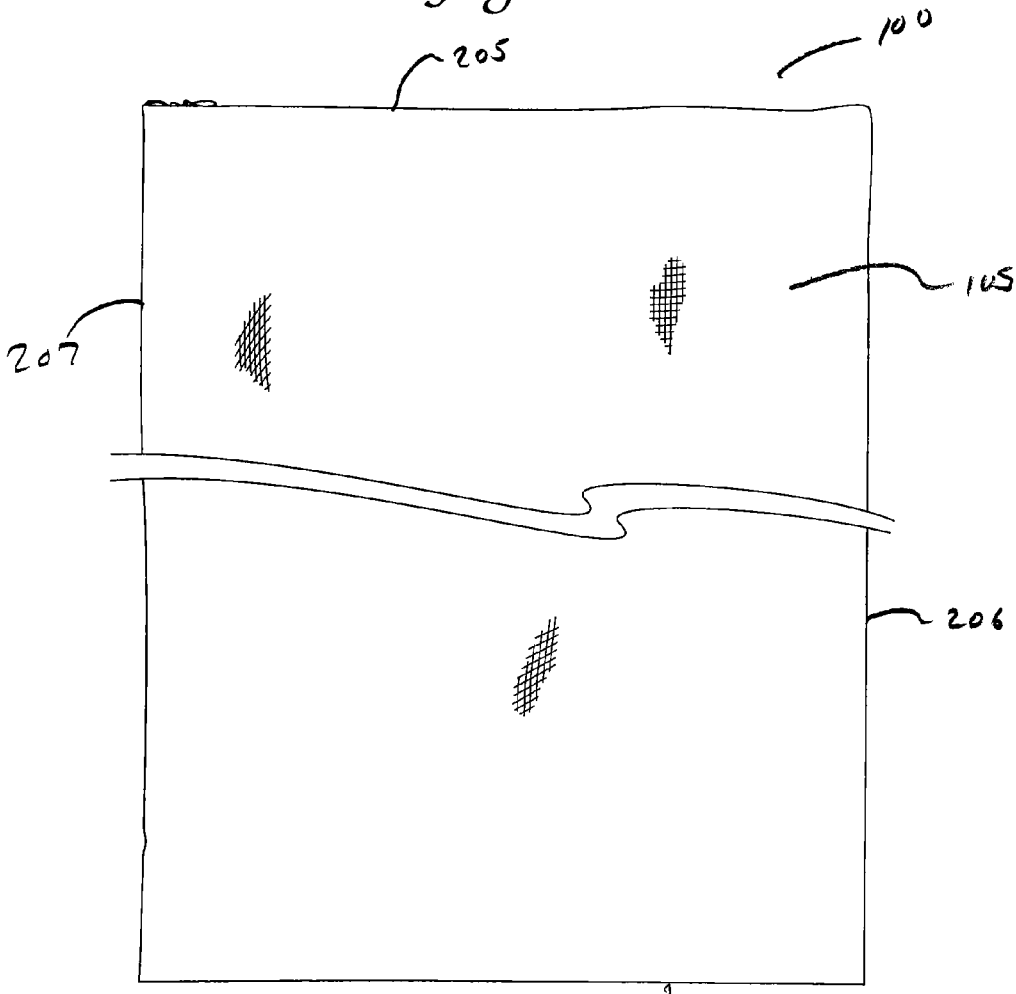
FIG. 3 depicts a perspective view of the garment with the securing mechanism on top of the garment.

Referring now to the drawings and more particularly to FIGS. 1, 2 and 3, which depict an illustrative embodiment consistent with the present invention. As depicted in FIG. 3, the illustrative garment 100 includes one or more sheets of material that form a shape, such as a rectangle, having opposite panels 108 and 110. In the illustrative example, the garment includes a single sheet of material that is folded at a back edge 206 to form the first panel 108 and second panel 110. The material sheet ends, which are opposite the back edge, meet and are secured to one another to form a front edge 207. The panels may be joined to one another at positions other than at their respective ends, such as at any point along the length of either panel. Further, the panels may be secured to one another along a length that is less than the entire length of the front or back edge, or may be secured along a plurality of separated sections along the front or back edge.

The two other edges of the panels, which may be perpendicular to the front and back edges, are at least partially unsecured, such that the garment is at least partially open at these opposite ends. One or both of the at least partially open ends includes a securing device 101 that secures the panels to one another along at least a portion of the respective edge. In the illustrative example, the securing device is a zipper and is located along the top edge of the garment from the front edge 207 corner to a point that is a distance W from the back edge 206. The securing device may have a start position and an end position that are anywhere along the respective edge. The securing device may be any suitable securing mechanism, such as but not limited to one or more zipper, buckle, button, snap, latch, hook, pin, lace, strap, Velcro™, and the like, or combinations thereof. Further, the securing device 101 can be attached to more than one of the edges 205, 206, 207 and 208 of the garment 100. When the garment is worn with the securing device on a person's back, for example, an extension means such as a ribbon or pull string can be used to aid the wearer in securing the garment in place.

The garment is not limited to a single sheet of material. Multiple sheets may be used in one or both of the panels. For example, each panel may comprise a different sheet of material, such that the sheets of material are secured to one another along the front edge and the back edge. In another illustrative example, the panels may each comprise a plurality of sheets of material.

The garment material may be any suitable material, such as but not limited to paper, cotton knit, cotton jersey, terrycloth, organic cotton, soybean, bamboo, rayon, silk chamois, cut velvet, silk chiffon, wool, synthetic material, plastic, metal and the like. Each panel includes an inner surface 104 and an outer surface 105. The various surfaces may comprise the same material type or different material types. The materials used in the garment panels are not limited to a specific size, color, or shape.

As FIGS. 1 and 2 depict, the inner and outer surfaces 104 and 105 are reversible. FIG. 1 depicts a top view with the outer surface 105 on the outside of the garment 100. FIG. 2 shows a bottom view.

FIG. 3 shows the illustrative example in which the bottom edge 208 of the garment 100 is open and the top edge 205 has the securing device 101, such as by thread, for closing and opening at least a portion of the top edge 205. As depicted in FIGS. 1 and 2, the securing device 101 on the top edge 205 extends part of the distance from the corner of the edge created by the intersection of front edge 207 and the top edge 205 towards the opposite corner created by the intersection of the top edge 205 and the back edge 206 before stopping at a securing point 106. The length from the securing point 106 to the corner created by the intersection of the top edge 205 and the back edge 206 is defined as the length W. W may be greater than or equal to 0. In the illustrative example, W is greater than 0. The length of the securing device 101 extending along the top edge 205 from the corner created by the intersection of the front edge 207 and the top edge 205 to the securing point 106 is defined as length Z. As described above, the securing device may alternatively start at a distance from the corner created by the intersection of the front edge 207 and the top edge 205, instead of starting at the corner.

Figures 4, 5, 6, 7:
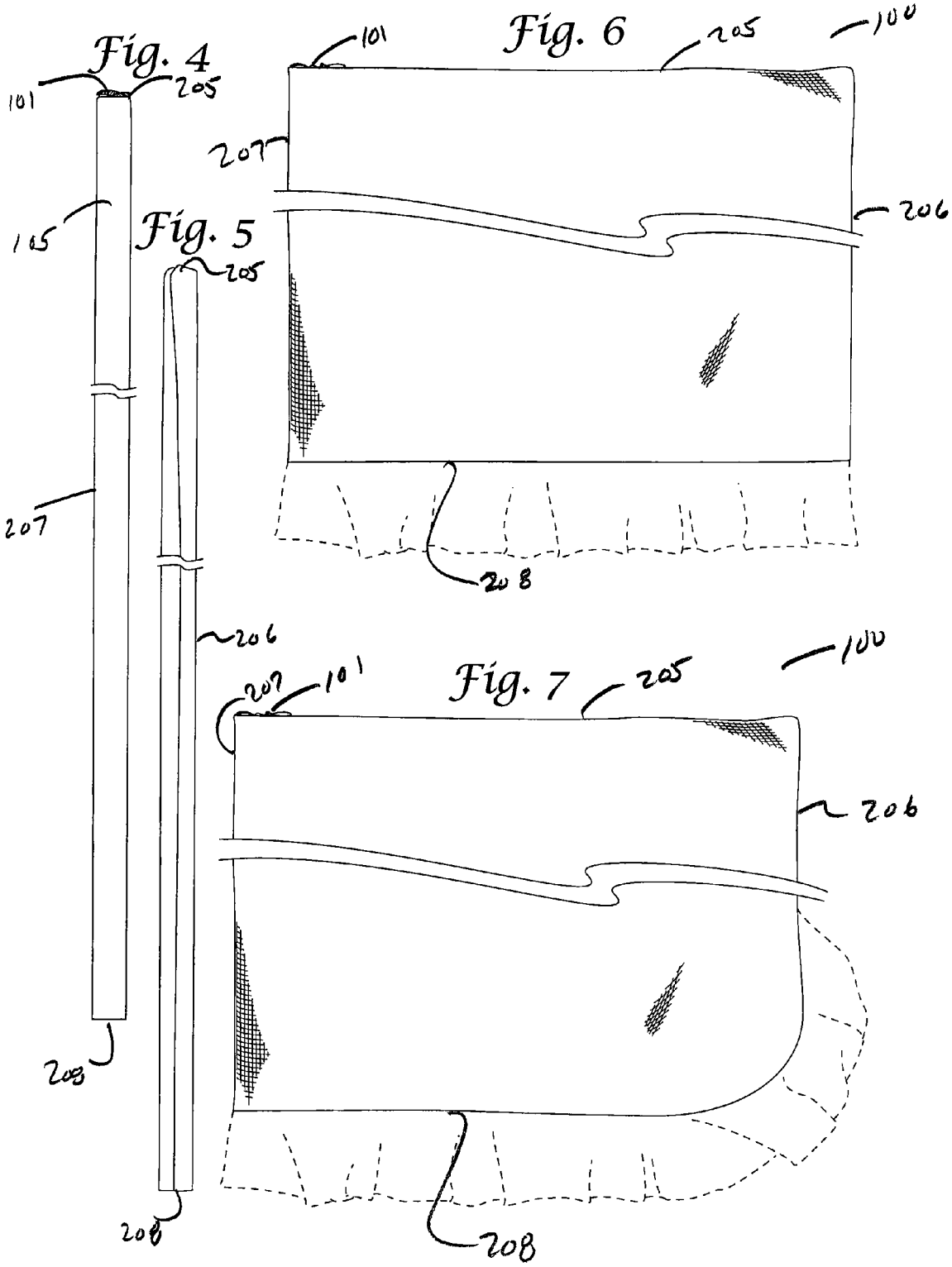
FIG. 4 depicts a first side view of the garment.
FIG. 5 depicts a second side view of the garment.
FIG. 6 depicts a perspective view of the garment with squared edges.
FIG. 7 depicts a perspective view of the garment with at least one rounded edge.

FIG. 4 depicts the front edge 207, which is created in the illustrative example when the material is folded. FIG. 5 depicts the back edge 205, which is created in the illustrative example when the panel edges opposite the front edge are adjoined together. In the event more than one sheet of material is used, FIG. 4 may have the same adjoining structure as depicted in FIG. 4.

In one embodiment, depicted in FIG. 6, edges 206, 207 and 208 form a rectangular shape with generally squared corners. In another embodiment, depicted in FIG. 7, edges 207, 206 and 208 form a rectangular shape with at least one corner formed by the intersection of the bottom edge 208 and the back edge 206 taking a rounded shape. Further, as depicted in FIG. 7, a ruffle or other ornamental device may be attached to the garment such as, but not limited to, lace, trim, ribbon, or any other ornamental device. Additionally, extra material sheets, not shown, can be appended to the existing sheets to enhance the draping effect of the garment. Also, vents may be added to the sides of the material to allow for additional openings in the fabric.

Figure 8:
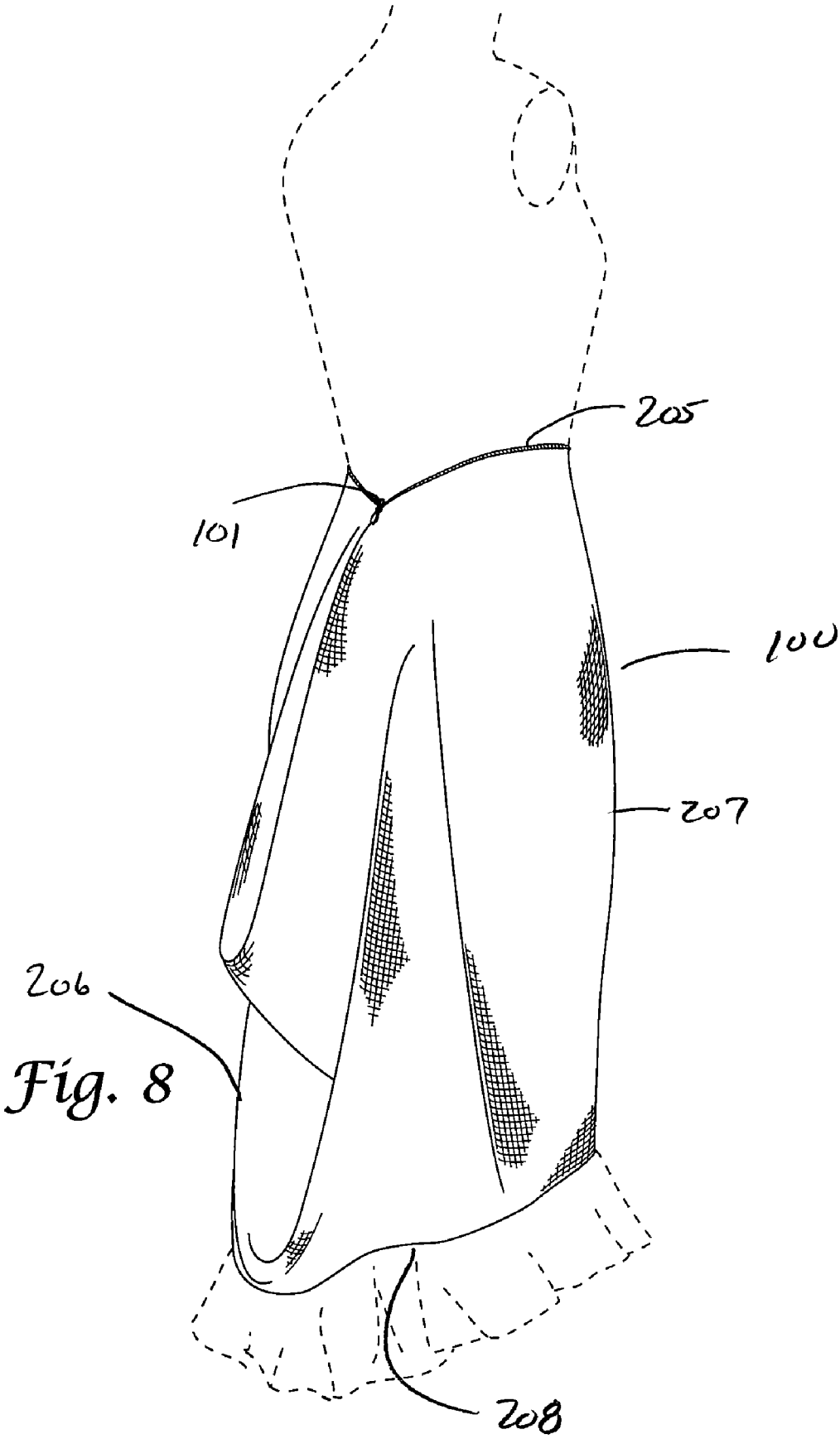
FIG. 8 depicts a back view of the garment worn around the waist.

In another embodiment, depicted in FIG. 8, the securing device 101 on the top edge 205 of the garment is secured around a person's waist with the lower portion of the person's body protruding out of the bottom edge 208. In this embodiment, the length W of the top edge is selected such that a portion of the length W of the top edge 205 and the back edge 206 extend downward along the person's back causing the material to gather in the lower portion of the garment 100. Further, in this embodiment, the length Z may be defined such that the adjustable opening formed by the securing device 101 in the non-secured position is large enough to accommodate a plurality of waist sizes.

Figure 9:
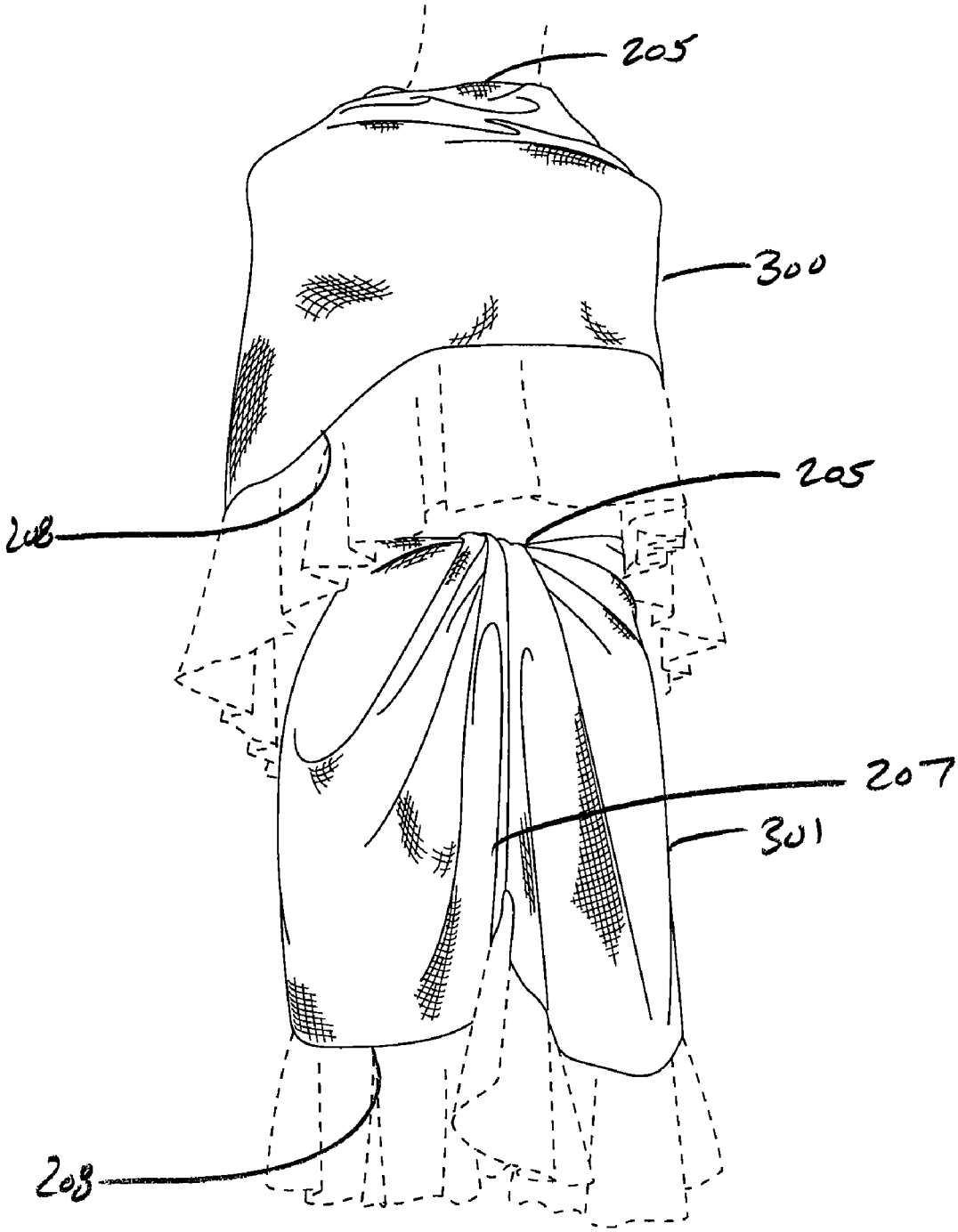
FIG. 9 depicts a front view of two garments worn at once.

In yet another embodiment, depicted in FIG. 9, two garments 300 and 301 may be worn simultaneously. The first garment 300 is secured, for example, over a person's shoulders by the securing device 101 on the top edge 205 of the garment and the lower chest of the person's body protruding out of the open side 208. In this embodiment, the length W of the top edge is selected such that a portion of the length W of the top edge 205 and the back edge 206 extend downward along the person's back causing the material to gather behind in the lower portion of the garment. Further, in this embodiment, the length Z may be defined such that the adjustable opening formed by the securing device 101 in the non-secured position is large enough to accommodate a plurality of shoulder sizes. Simultaneously, a second garment 301 is worn around a different part of the body, such as around the waist.

In yet another embodiment, depicted in 9A, multiple garments are attached to one another to form a single larger garment. In this embodiment, both the top edge 205 and the open edge 208 have securing devices 101. Further, the top edge 205 of a first garment may be secured around a person's waist and the top edge 205 of a second garment attaches to the securing device 101 of the open end 208 of the first garment. Accordingly, the top edge of a third garment may be secured to the open end 208 of the second garment creating layers of fabric. In another embodiment, the open edge of at least one garment includes elastic to confine the garment to the wearer. In yet another embodiment, a belt may be worn around the waist of the wearer to support the garment on the wearer. In one implementation, each garment includes lace or trim on the open side 208 or top side 205.

In one implementation, multiple garments are secured around the wearer's waist to create a single larger garment with a layered effect. In this implementation, the lengths of each garment vary such that different garments are visible at different positions on the larger garment. As a illustrative example, one garment may be made of a opaque fabric, while the next longer garment may be made of a sheer fabric. Wearing the garments as this embodiment suggests, creates a single multilayered garment. In another embodiment, the open edge of at least one garment includes elastic to confine the garment to the wearer. In yet another embodiment, a belt may be worn around the waist of the wearer to support the garment on the wearer. In one implementation, each garment includes lace or trim on the open side 208 or top side 205

Figure 9A:
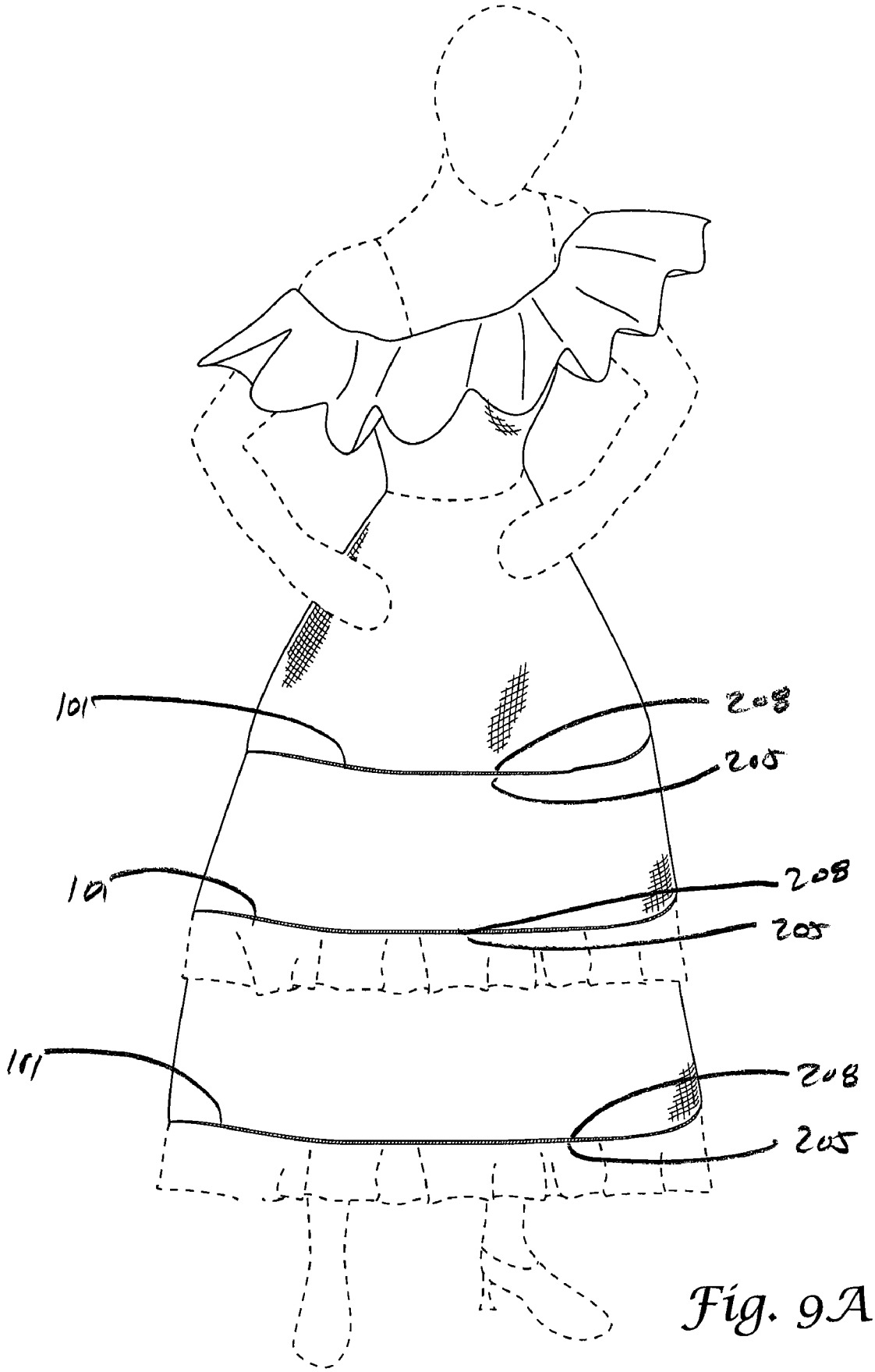

In yet another embodiment shown in FIG. 9A, one of the multiple garments may have the top side 205 attached to the top side 205 of a lower garment. The open side 208 of the upper garment is then pulled up to create a shirt or top which is attached to the lower garments. In this embodiment, the open end 208 of the upper garment may include a securing device 101 which may be used to secure the upper garment around the neck or chest of the wearer. Further, the second garment may have straps 902 or a elastic band to secure the garment over the shoulders of the wearer.

Figure 10:
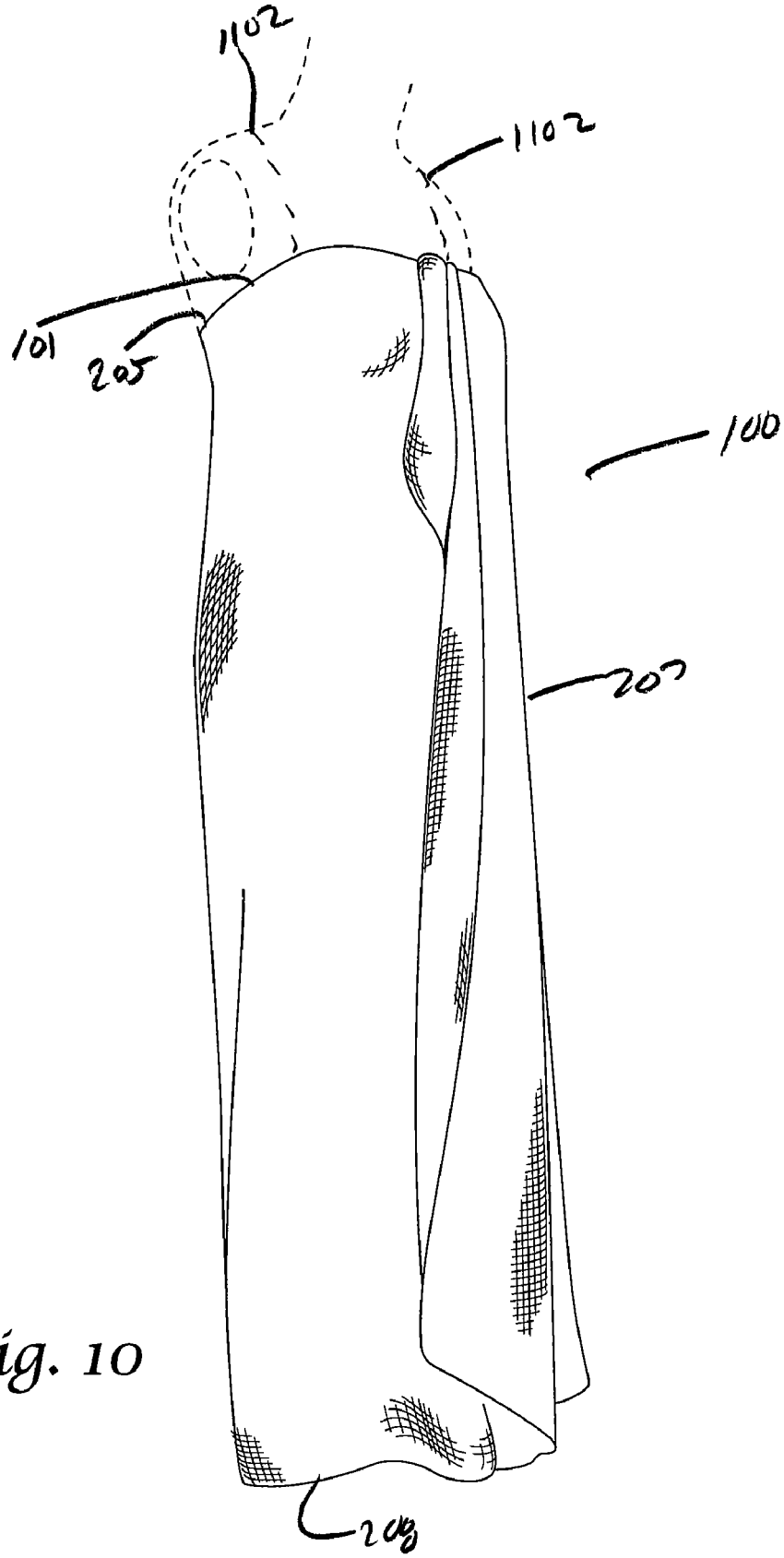
FIG. 10 depicts a front view of the garment worn around the chest.

In another embodiment, depicted in FIG. 10, the securing device 101 on the top edge 205 of the invention is secured around a person's chest with the lower portion of the person's body protruding out of the open bottom edge 208. In this embodiment, the length W of the top edge is selected such that a portion of the length W of the top edge 205 and the back edge 206 extend downward along the person's chest causing the material to gather in front portion of the garment 100. As FIG. 11 demonstrates, the portion W can be tucked into the opening created between the securing device 101 and the securing point 106. Further, in this embodiment, the length Z may be defined such that the adjustable opening formed by the securing device 101 in the non-secured position is large enough to accommodate a plurality of chest sizes. In another embodiment, straps 1102 may be provided to further support the garment on the wearer. The material used to made the straps may include, but not be limited to, string, rope, lace, yearn, fabric, plastic, chain, elastic, VELCRO and ribbon.

As described above, the garment may be secured about various places on the wearer and at various positions on the wearer's body. One having skill in the art will appreciate that the garments of the various embodiments described below may be a same garment worn in the various illustrative configurations, or may be different garments having various configurations. In the embodiment depicted in FIG. 11, the securing device 101 at the top edge 205 of the garment is secured around a person's chest with the person's legs protruding out of the bottom edge 208. In this embodiment, the length W of the top edge 205 is selected such that a portion of the length W of the top edge 205 and the back edge 206 extend downward along the person's back causing the material to gather in the lower portion of the garment 100. Further, in this embodiment, the length Z may be selected such that the adjustable opening formed by the securing device 101 in the non-secured position is large enough to accommodate a plurality of chest sizes. By making the opening formed by the securing device 101 adjustable, a single size of the garment 100 can be worn by a multitude of people each with a different body size and type.

Figure 11:
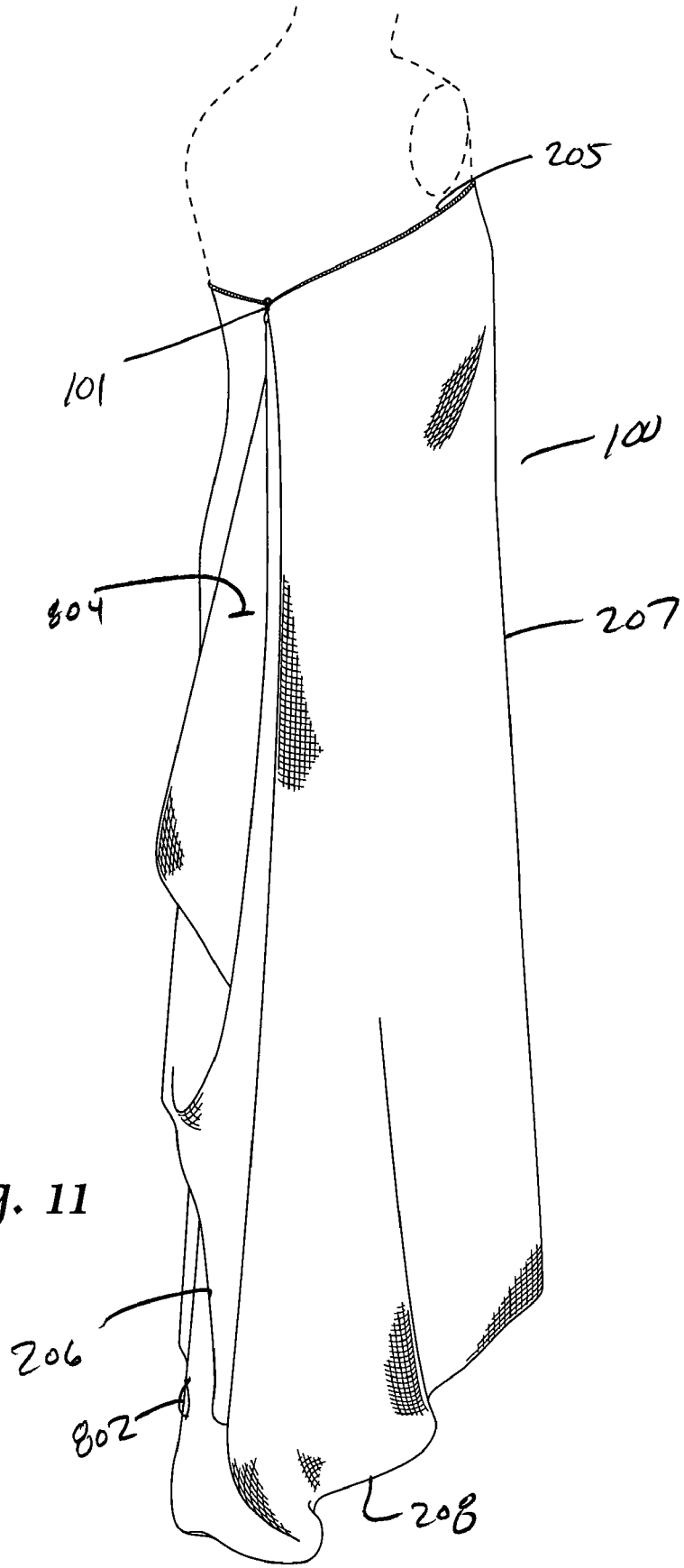
FIG. 11 depicts a back view of the garment worn around the chest.

In another embodiment, depicted in FIG. 11, a drape securing device 802 and a drape receiving device 804 are located on the back edge 206 of the garment and may be used to secure the fabric draping from the back edge 206 of the garment. The drape receiving device 804 may be located along the edge 206 between the securing device 101 and open end 208. The drape securing device may be located along the edge 206 between the drape receiving device 802 and the open end 208. For example, if the draping portion of the garment acted as a train, the drape securing device 802 may be used to secure the train with the drape receiving device 804 to the garment such that the train would no longer drag on the ground. The drape securing device 802 may include, but not be limited to, a single latching device or any combination of, buckles, buttons, snaps, latch and hook connections, pins, laces, straps, and other connection types. The drape receiving device 804 may include, but not be limited to, a single receiving device or any combination of, button hole, buckles, snaps, latch and hook connections, pins, laces, straps, and other connection types. In one implementation, the drape securing device 802 is hidden in fabric. In yet another embodiment, the drape receiving device 804 is located along the seam of the securing device 101.

Figure 12:
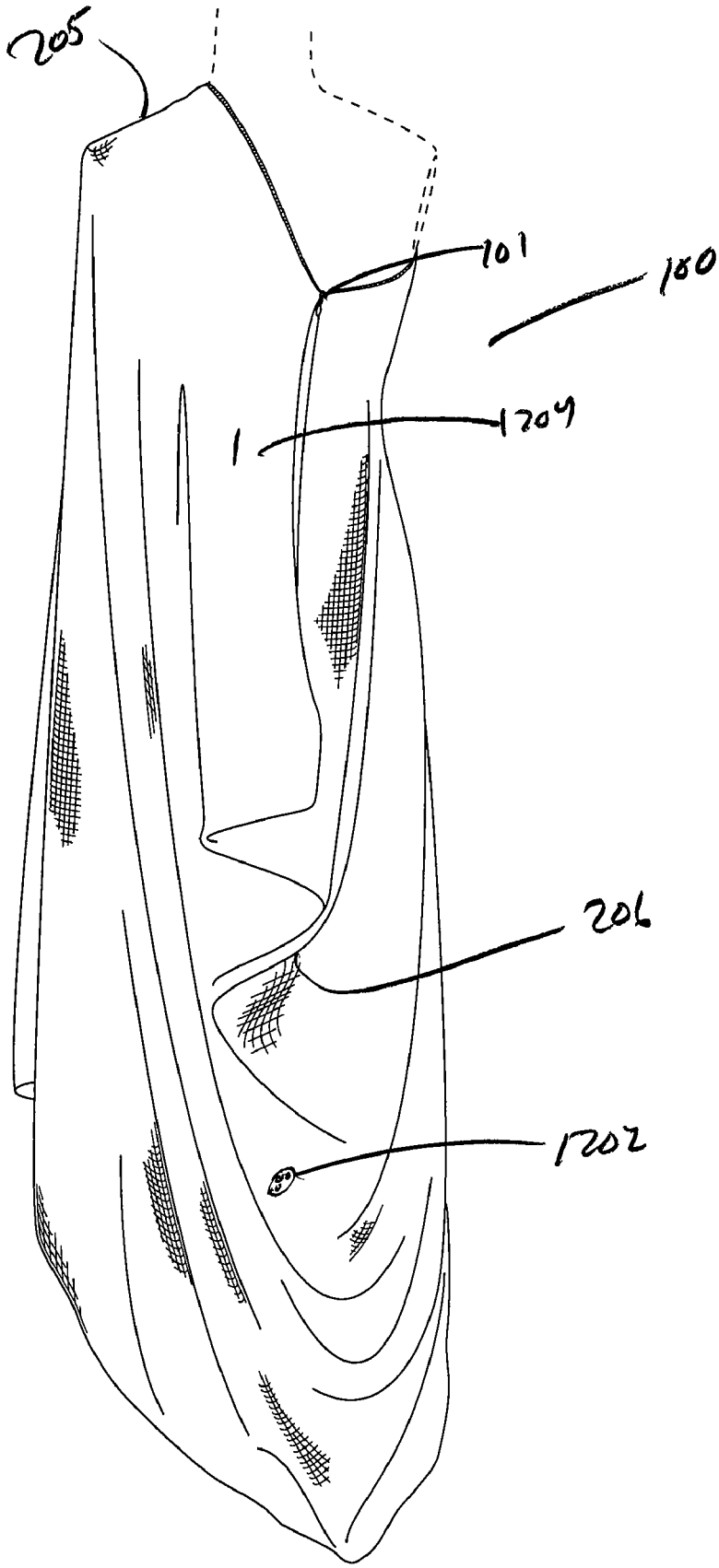
FIGS. 12 and 12A depict a back view of the garment worn over one shoulder.

In another embodiment, depicted in FIG. 12, the securing device 101 on the top edge 205 of the garment is secured over one shoulder with another portion of the securing device located under the person's arm and the lower portion of the person's body protruding out of the open side 208. In this embodiment, the length W of the top edge is selected such that a portion of the length W of the top edge 205 and the back edge 206 extend downward along the person's back causing the material to gather in the lower portion of the garment 100. Further, in this embodiment, the length Z may be defined such that the adjustable opening formed by the securing device 101 in the non-secured position is large enough to accommodate a plurality of shoulder sizes. By making the opening formed by the securing device 101 adjustable, a single size of the garment 100 can be worn by a plurality of people of varying body types.

Figure 12A:
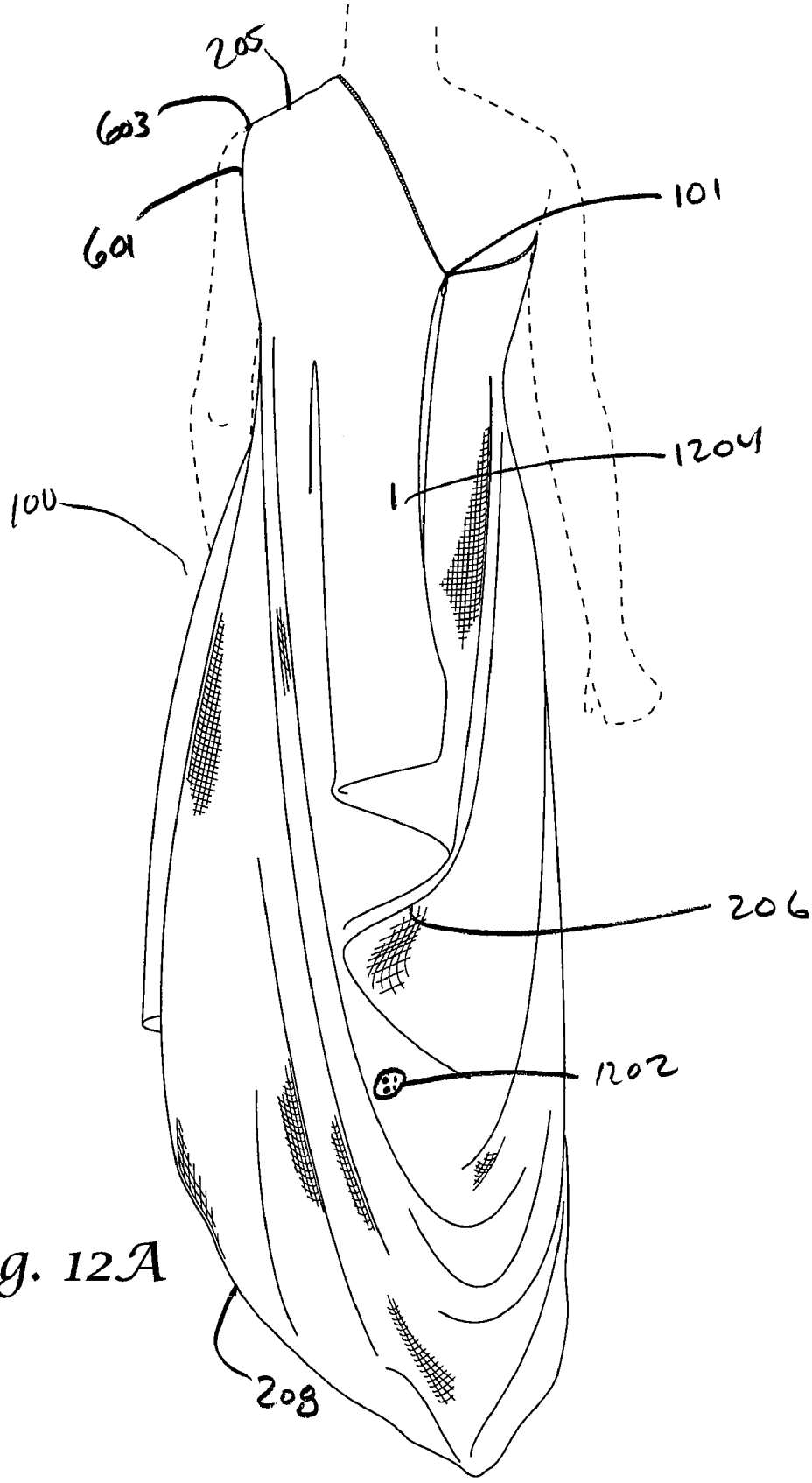

In another embodiment, depicted in FIG. 12A, the securing device 101 on the top edge 205 of the invention is secured over one shoulder with another portion of the securing device located under the person's arm and the lower portion of the person's body protruding out of the open side 208. In this embodiment, the length W of the top edge is selected such that a portion of the length W of the top edge 205 and the back edge 206 extend downward along the person's back causing the material to gather in the lower portion of the garment 100. Further, in this embodiment, the length Z may be defined such that the adjustable opening formed by the securing device 101 in the non-secured position is large enough to accommodate a plurality of shoulder sizes. By making the opening formed by the securing device 101 adjustable, a single size of the garment 100 can be worn by a plurality of people of varying body types. Also in this embodiment, an optional arm hole 601 is located on either one of the sides of the garment to allow the wearer to place an arm through the opening. A securing device 603 may be located on the edge of the opening, allowing the user to open or close the arm hole 601.

In another embodiment, depicted in FIGS. 12 and 12A, a drape securing device 1202 and a drape receiving device 1204 are located on the back edge 206 of the garment and may be used to secure the fabric draping from the back edge 206 of the garment. The drape receiving device 1204 may be located along the edge 206 between the securing device 101 and open end 208. The drape securing device may be located along the edge 206 between the drape receiving device 1202 and the open end 208. For example, if the draping portion of the garment acted as a train, the drape securing device 1202 may be used to secure the train with the drape receiving device 1204 to the garment such that the train would no longer drag on the ground. The drape securing device 1202 may include, but not be limited to, a single latching device or any combination of, buckles, buttons, snaps, latch and hook connections, pins, laces, straps, and other connection types. The drape receiving device 1204 may include, but not be limited to, a single receiving device or any combination of, button hole, buckles, snaps, latch and hook connections, pins, laces, straps, and other connection types. In one implementation, the drape securing device 1202 is hidden in fabric. In yet another embodiment, the drape receiving device 1204 is located along the seam of the securing device 101.

Figure 13:
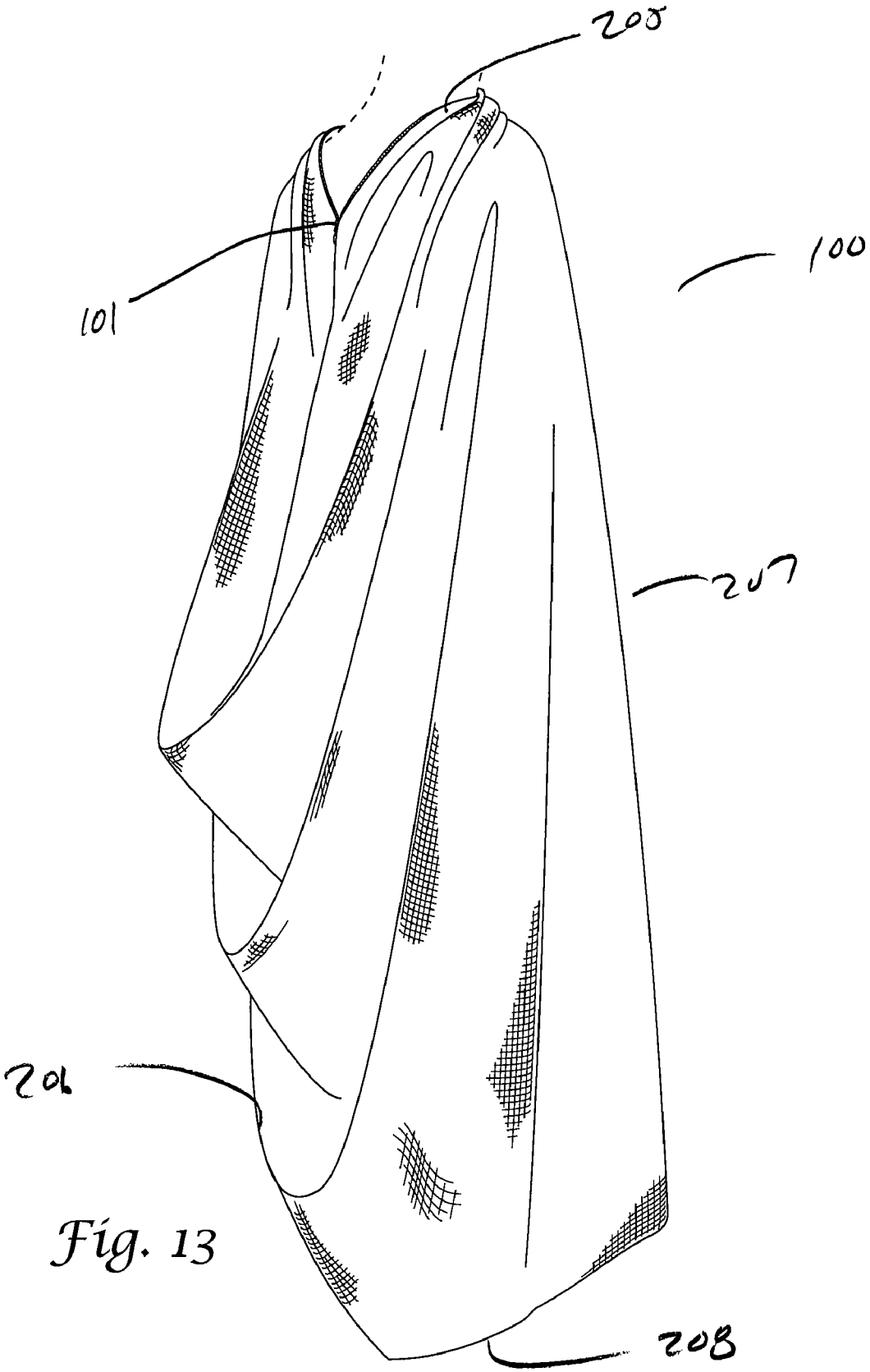
FIGS. 13, 13A and 13B depict a back view of the garment worn off the shoulder.

In yet another embodiment, depicted in FIG. 13, the securing device 101 on the top edge 205 of the garment is secured around a person's shoulders with the lower portion of the person's body protruding out of the open bottom edge 208. In this embodiment, the length W of the top edge is selected such that a portion of the length W of the top edge 205 and the back edge 206 extend downward along the person's back causing the material to gather in the lower portion of the garment 100. Further, in this embodiment, the length Z may be defined such that the adjustable opening formed by the securing device 101 in the non-secured position is large enough to accommodate a plurality of shoulder sizes.

Figure 13A:
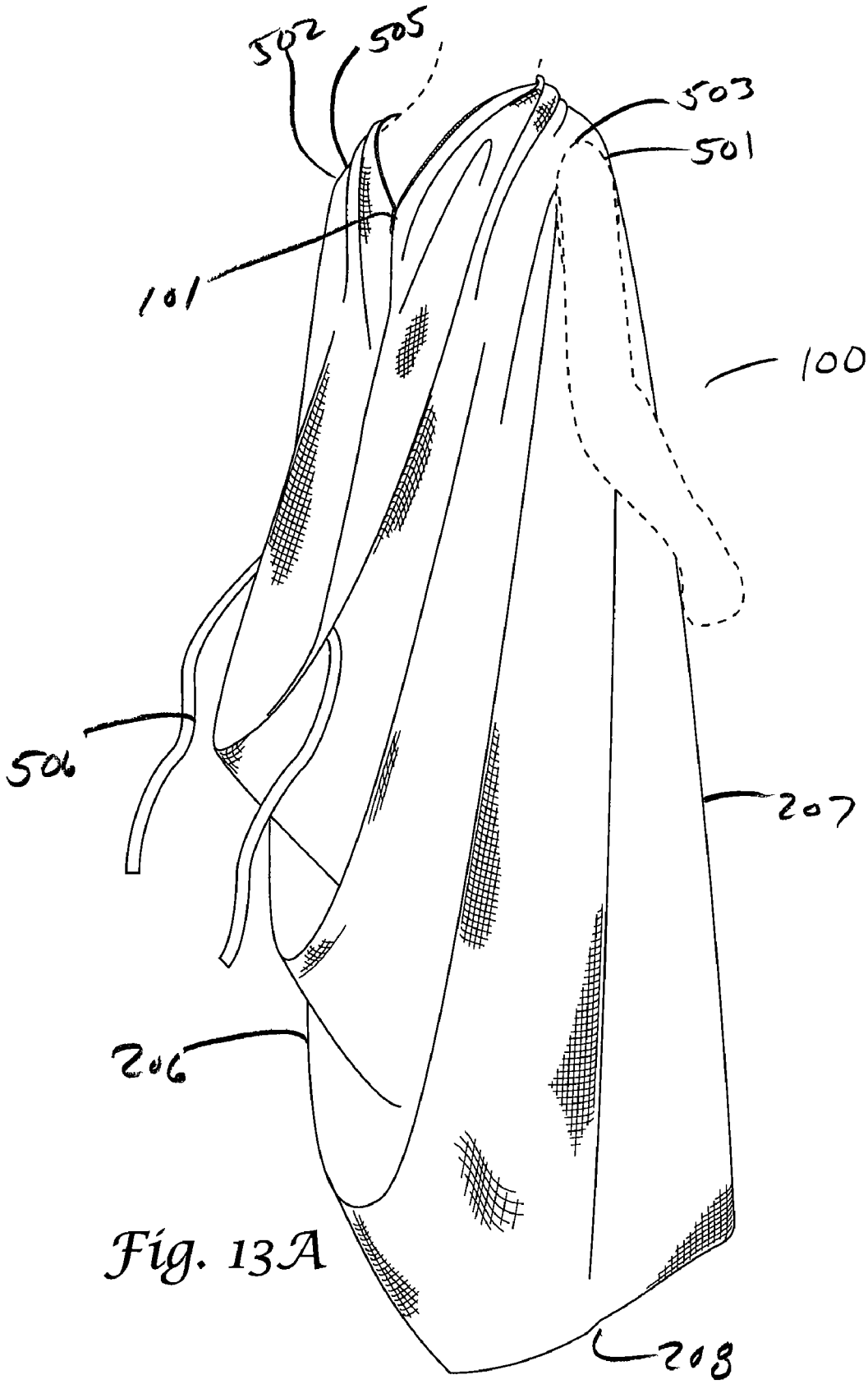

In yet another embodiment, depicted in FIG. 13A, the securing device 101 on the top edge 205 of the garment is secured around a person's shoulders with the lower portion of the person's body protruding out of the open side 208. In this embodiment, the length W of the top edge is selected such that a portion of the length W of the top edge 205 and the back edge 206 extend downward along the person's back causing the material to gather in the lower portion of the garment 100. Further, in this embodiment, the length Z may be defined such that the adjustable opening formed by the securing device 101 in the non-secured position is large enough to accommodate a plurality of shoulder sizes. Also in this embodiment, two optional arm holes 501 & 502 are located on opposing sides of the garment panels, allowing the wearer to place their arms through the openings. Securing devices 503 & 505 may be provided on the edge of each opening, allowing the user to open or close each arm hole 501 & 502.

Figure 13B:
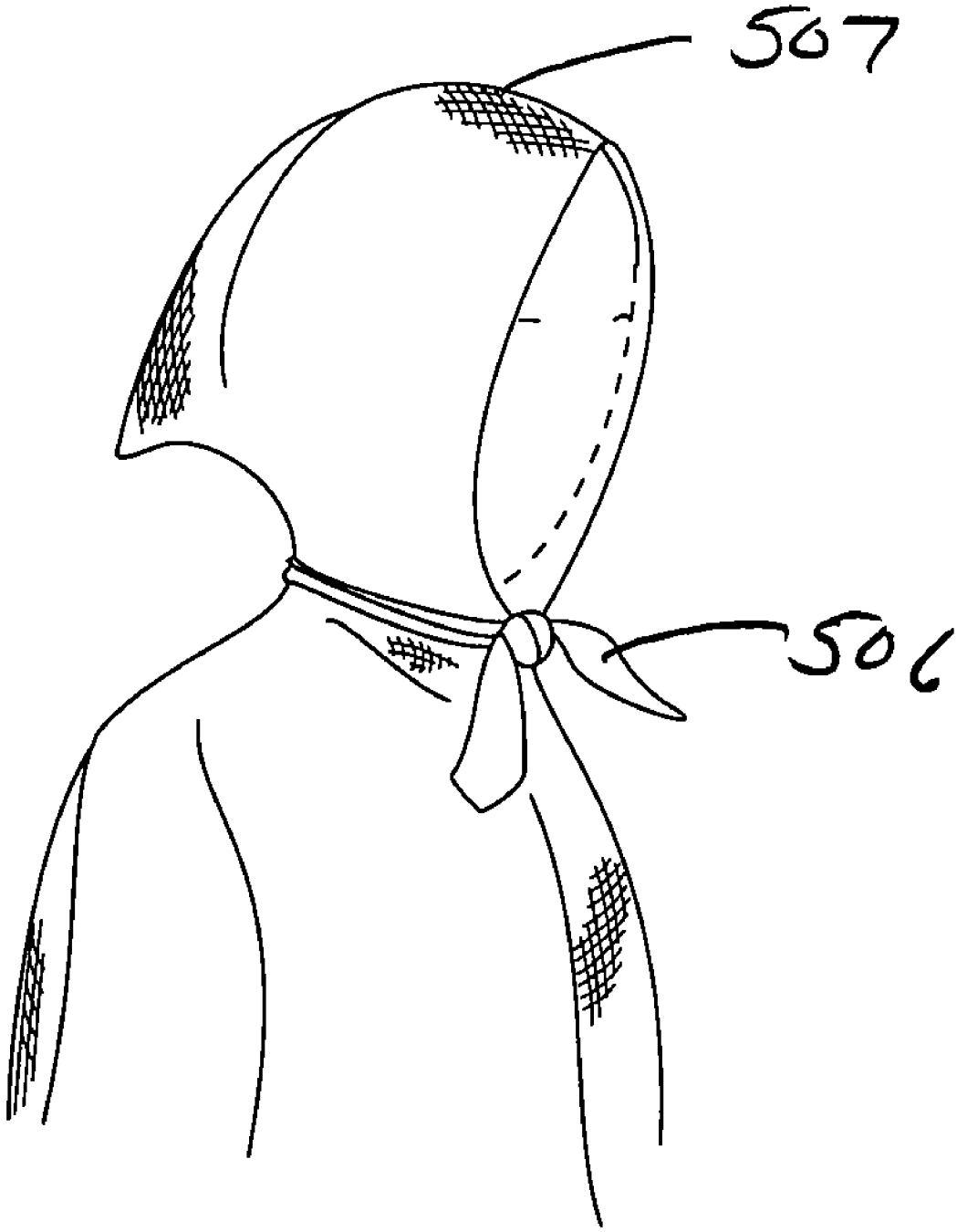
Figure 14:
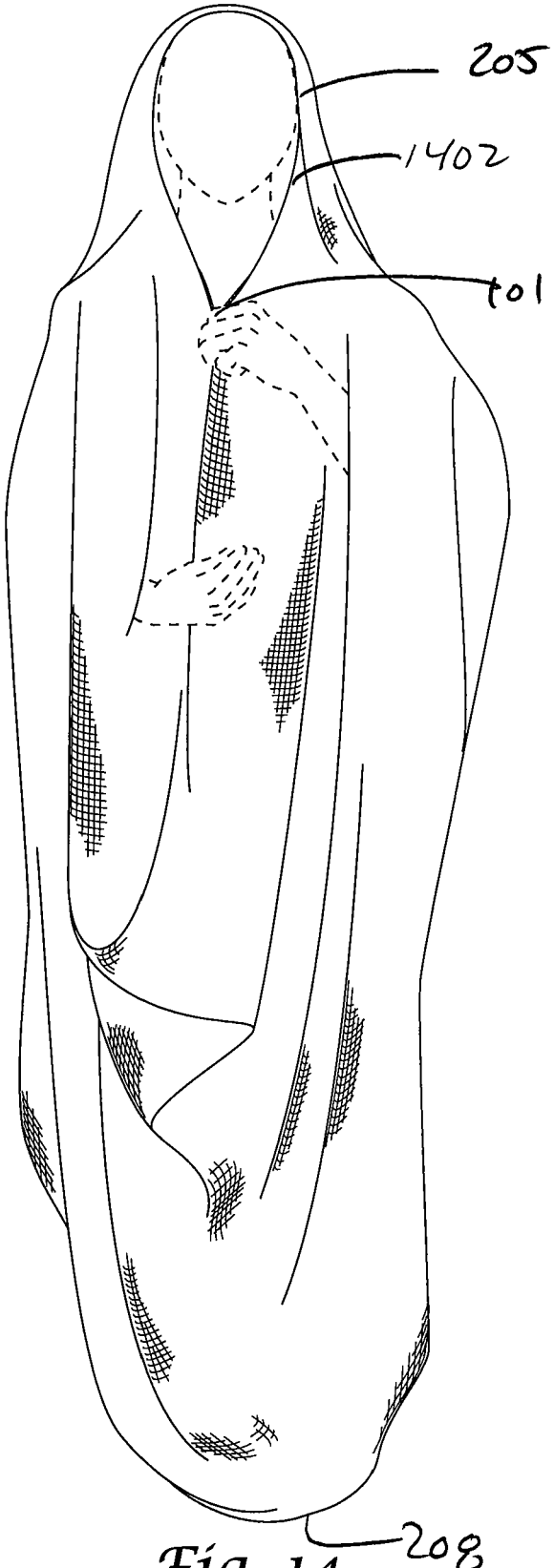
FIG. 14 depicts a front view of the garment worn around the head.

In another embodiment, depicted in FIG. 13B, a gathering device 506 is attached to the draping fabric 507 on the back of the garment which assists the wearer in pulling the draping fabric 507 over the wearer's head like a hood. In another embodiment, the gathering device 506 may be used to secure the lower portion of the gathered fabric 507 around the neck of wearer to secure the hood to the wearer. Additionally, the gathering device 506 may be used to gather the fabric in the back of the garment in a decorative arrangement. In another embodiment, the gathering device may be secured around the waist of the wearer to further secure the garment to the wearer. The material used to make the gathering unit 506 may include, but not be limited to, elastic, fabric, string, Velcro, yearn, and lace. In another embodiment, the draping fabric may be secured in the securing device 101 by tucking the end of the excess fabric into the opening created where the opening in the top edge 205 created by the securing device 101 ends.

In yet another embodiment, depicted in 14, the wearer may place their head through the garment such that the wearer's face protrudes through the opening in the top edge 205. In this embodiment, the securing device 101 is used to secure the opening around the wearer's face. The length of the garment may vary to allow the fabric to extend downward to the shoulders or to cover the entire body of the wearer. A second fabric may be installed around the perimeter of the opening to firmly secure the garment around the person's face. The second fabric may include, but is not limited to, elastic, a rope or string encased in a fabric channel around the perimeter of the opening, a zipper, at lease one button, or any other securing device.

In one implementation of this embodiment, a securing device 101 is attached to the top edge 205 and the open edge 208. The top end 205 may be pulled over the wearer's head and the open edge 208 may be secured with the additional securing device 101 creating a sleeping bag.

Figure 15A:
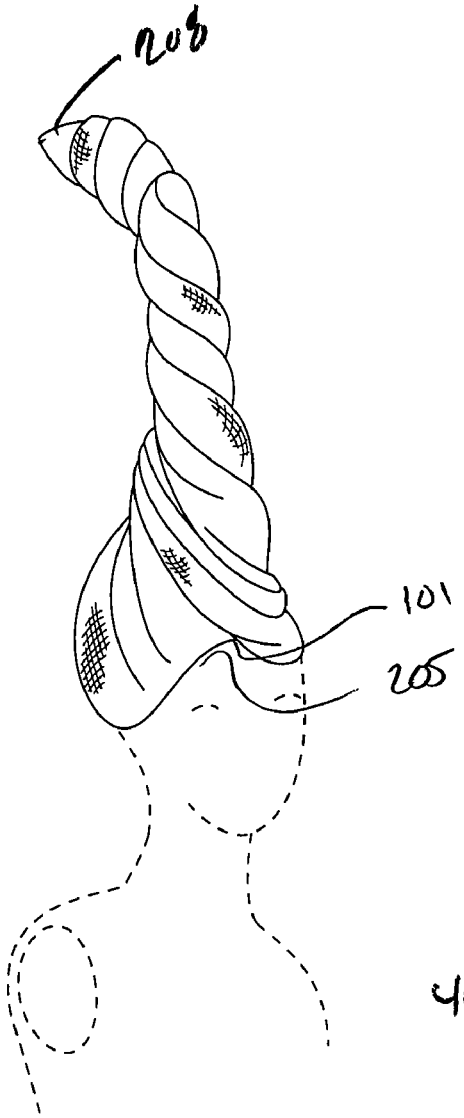
FIGS. 15A, 15B and 15C depict a front view of the garment worn around the head
Figure 15B:
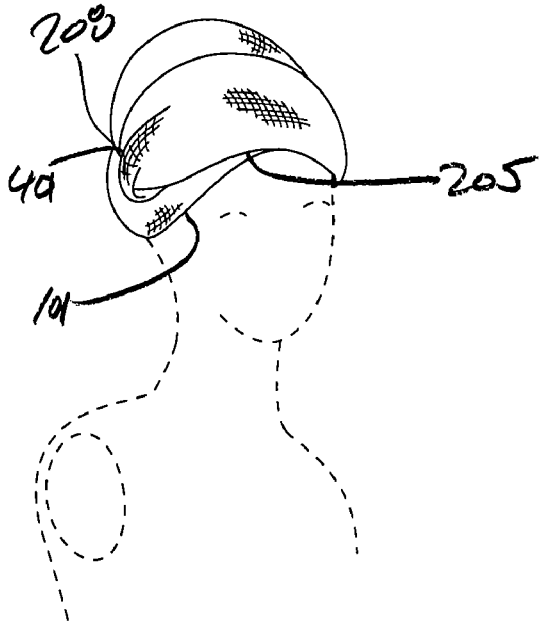

In one embodiment, depicted in FIG. 15A, the garment is secured around the head of the wearer and is twitched above the head of the wearer. In yet another embodiment, depicted in FIG. 15B, the garment is secured around a wearer's head by the securing device 101 on the top edge 205 of the invention open side 208 is left to drape behind the wearer's head. In this embodiment, the length W of the top edge is selected such that a portion of the length W of the top edge 205 and the back edge 206 extend downward along the wearer's neck causing the material to gather behind the head of the wearer. Additionally, depicted in 15B, open side 208 may be wrapped around the head of the wearer and tucked into the folds 401 created therein. Further, in this embodiment, the length Z may be defined such that the adjustable opening formed by the securing device 101 in the non-secured position is large enough to accommodate a plurality of head sizes.

Figure 15C:
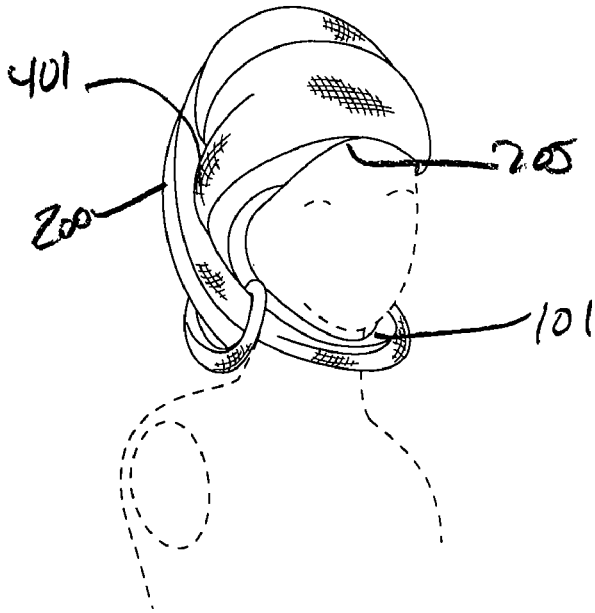

FIG. 15C depicts another embodiment consistent with the present invention where the top end 205 of the garment is positioned around the head of the wearer. The open end 208 is then wrapped around the head a number of times. Further, the open end 208 may be secured in a fold of the garment created when the garment is wrapped around the head of the wearer. In addition, the garment may be wrapped around the neck of the wearer creating a scarf. In another embodiment, the garment may be coupled to feathers or fringe which will give the illusion of hair.

As one skilled in the art would appreciate, making a garment with an adjustable opening simplifies the manufacturing process because fewer size variations are required. Additionally, the ordering and inventory process becomes simplified because fewer different types of garments are required to fill inventory stock. Additionally, clients using the garment have the ability to use the garment for a variety of occasions thereby reducing the amount of clothing in their wardrobe.

Further, the garment lends itself to a unique way of dressing according to the drape and the individuality of the fabric chosen for each piece. The drape and combination of the fabrics have a unique way of working for any body type or occasion. Due to a universal sizing defined by the length of each piece, the garment may be positioned at different lengths and fits according to each person's proportion. There is no designated front or back, right or wrong use and can be customized according to individual's desired use. According to the length selected, the garment is very flexible and may be zipped up or down the whole body. As an example it may be zipped at the waist, chest, neck or off the shoulder or frontward or backwards. Whether the wearer is going from a workout, the grocery store, school, lunch, dinner, the beach, the theatre or hopping on a plane, they just zip up and go.

It is not always just how something looks that matters but of equal importance it is how the garment feels to be worn by the individual. The garment promotes individuality and a greater sense of well being by a new way of thinking, dressing or draping. Additionally, the garments versatility allows loved ones to share the garments to maximize their use. For example, a parent and child may purchase a garment to wear as a skirt for the parent and as a dress for the child.

In an illustrative embodiment, the garment may be worn for example by a person who is undergoing medical treatment, such as treatment of cancer. The inventor has recognized that there may be times that the body may go through sudden changes and a person may feel embarrassed to be seen in public unless they are wearing comfortable or attractive clothes. The garment consistent with the present invention helps encourage a person to go out into the world and share or make the most of a moment with less personal stress. Whether it is mind over matter, if a person is more comfortable and feels more beautiful, they may begin to feel better and healthier. Perhaps they may choose to run that extra mile if a person feels more attractive wearing the garment as an over garment. The garment over a form fitted pant for women may provide a more becoming feminine look and women may be less self conscious while working out. The garment flows and moves due to the drape of the fabric.

The garment is a unique form of clothing or wearable art that can provide a great new form of therapy that will inspire a higher sense of self-respect and pride. Thus, the garment inspires the whole body and uplifts the spirit while the whole person may feel more beautiful and balanced in order to promote a sense of well being.

In another illustrative embodiment, the garment may be worn for example by a person participating in an adventurous travel activity such as rock climbing, hiking, or camping. The versatility of the garment allows for different uses of the same garment from wearing the garment as a over coat or a hood to using the garment while sleeping in a sleeping bag for extra warmth. As in the inventor has learned, a person wearing the garment can warm or cool themselves by opening or closing the securing device. This feature lends itself nicely to activities where the wearer will require more warmth during one portion of a activity and less warmth during other portions of the activity.

In another illustrative example, the garment may be worn for example by a person receiving medical treatment in lieu of a hospital gown. As the inventor has learned, the simplicity of the garment allows a person to easily take the garment on and off during medical treatment. Additionally, the fit of the garment along with the fabrics used provide additional comfort to the patient while receiving medical treatment.

In another illustrative example, the garment may be used as a dress or high fashion garment. As the inventor has learned, the versatility of the garment allows for numerous variations of a single garment to create different designs and fits based on the needs of the person. Additionally, since the garment may be shaped in a plurality of different manners, the ultimate look and feel of the garment is left to the creativity of the wearer.

While various embodiments consistent with the present invention have been described, it will be apparent to those of skill in the art that many more embodiments and implementations are possible that are within the scope of this invention. Accordingly, the present invention is not to be restricted except in light of the attached claims and their equivalents.

What is claimed is:

1. A garment comprising:

a first panel of material;

a second panel of material opposite the first panel of material and secured to the first panel of material along a first connection line and a second connection line, which is spaced apart from and generally parallel to the first connection line, a first end of the first and second panels and a second end of the first and second panels being at least partially unsecured to one another providing a first opening in the garment at the first end and a second opening in the garment at the second end, the first end and the second end each being generally perpendicular to the first connection line and the second connection line; and a securing device attached along a first portion of the first end that removeably secures the first panel to the second panel along the first end, wherein, the first panel and second panel are non-removably affixed to one another along an entire length of a second portion of the first end, the second portion extending from an end of the securing device to a corner created by the intersection of the first end and the first or second connection line, and the securing device tightens the first opening at the first end about a wearer of the garment.

2. The garment of claim 1, wherein an inner face and an outer face of each of the first and second panels are reversible.

3. The garment of claim 1, wherein the securing device is selected from the group consisting of a zipper, a buckle, a button, a snap, a latch, a hooks, a pin, laces, a strap, and hook and latch fasteners.

4. The garment of claim 1, wherein at least one of the corners formed at the intersection of the first panel and the second panel is rounded.

5. The garment of claim 1, wherein an ornamental feature is attached to at least one of the edges.

6. The garment of claim 1, wherein the first end of the first and second panels fit about a user at one of the user's neck, head, shoulders, chest, and waist.

7. The garment of claim 1 further comprising:

a first opening formed in the first connection line; and a second opening formed in the second connection line.

8. The garment of claim 1, wherein the first panel and the second panel are formed of a common piece of material.

9. The garment of claim 1, wherein the second end is connected to the first end of another garment.

10. The garment of claim 1, further comprising a drape securing device positioned on the first or second panel;

a drape receiving device positioned between the drape securing device and the securing device, wherein, the drape securing device is effective to engage the drape receiving device such that excess material from the first or second panel is elevated from the floor.

11. The garment of claim 10 wherein, the drape securing device is selected from the group consisting of a zipper, a buckle, a button, a snap, a latch, a hooks, a pin, laces, a strap, and hook and latch fasteners.

12. The garment of claim 10 wherein, the drape receiving device is selected from the group consisting of a button hole, a zipper, a buckle, a button, a snap, a latch, a hooks, a pin, laces, a strap, and hook and latch fasteners.

13. The garment of claim 1, further comprising a gathering device attached to the first panel or second panel that is effective to secure the first panel or second panel around the user's head, neck or waist.

14. The garment of claim 1, wherein a gathering device is made from a material selected from a group comprising string, rope, lace, yarn, fabric, plastic, chain, elastic, hook and latch fasteners and ribbon.

15. The garment of claim 1, further comprising at least one strap secured to the edges of the first panel or second panel configured to support the garment on the user's shoulder.

16. The garment of claim 1, wherein the securing device of the first end of one garment attaches to the securing device on the first end of a separate garment such that the garments are layered on one another.

* * * * *